United States Patent [19]

Barathe et al.

[11] 4,305,242

[45] Dec. 15, 1981

[54] VACUUM BAGGING DEVICE WITH A FLEXIBLE SPOUT AND PROGRAMMING SYSTEM

[75] Inventors: Christian Barathé, Melun; Christian Chervalier, Solers; Gaston Wiel, Paris, all of France

[73] Assignee: Generale d'Entreprise de Conditionnement, Verneuil-l'Etang, France

[21] Appl. No.: 98,975

[22] Filed: Nov. 30, 1979

[30] Foreign Application Priority Data

Dec. 5, 1978 [FR] France ..... 78 34165
Oct. 30, 1979 [FR] France ..... 79 26857

[51] Int. Cl.[3] ..... B65B 43/26
[52] U.S. Cl. ..... 53/512; 141/59; 141/314; 53/570
[58] Field of Search ..... 53/434, 512, 432, 510, 53/384, 570; 141/59, 60, 7, 10, 67, 68, 114, 165, 166, 312, 313, 314, 315–317

[56] References Cited

U.S. PATENT DOCUMENTS

| | | | |
|---|---|---|---|
| 3,150,472 | 9/1964 | Moore | 53/512 X |
| 3,851,444 | 12/1974 | Merat | 53/570 X |
| 4,174,599 | 11/1979 | Callet et al. | 53/512 |
| 4,189,899 | 2/1980 | Merat et al. | 53/512 X |

*Primary Examiner*—James F. Coan
*Attorney, Agent, or Firm*—Barry Kramer

[57] ABSTRACT

This invention is a vacuum bagging device which consists of a receiving bag separated from the product to be conditioned by a flexible and deformable spout. This spout is electropneumatically operated. The receiving bag is made of a material which can be thermo welded. It receives under vacuum the product to be conditioned which remains in this state until the welding operation takes place, the latter being achieved by thermocompression of the upper part of the bag. The operations are synchronized by a programming electromechanical circuit. This invention can be used for fast conditioning and bagging of powdery, granulated or pulverized products, whatever their quantity.

8 Claims, 10 Drawing Figures

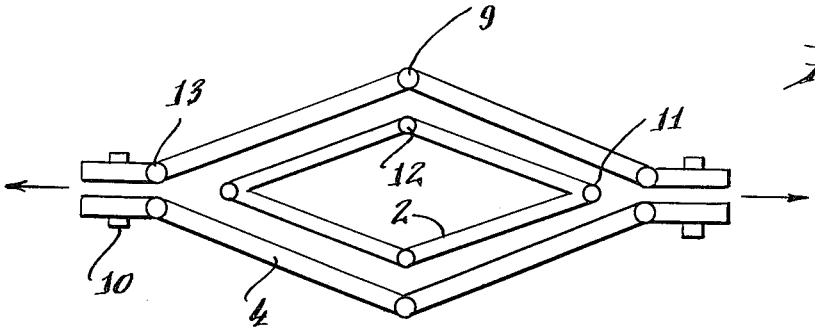
Fig. 3.
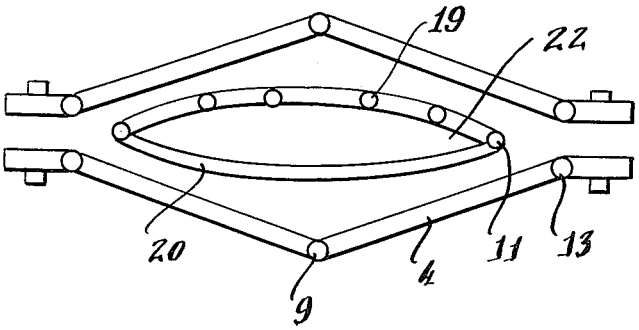
Fig. 4.
Fig. 5.
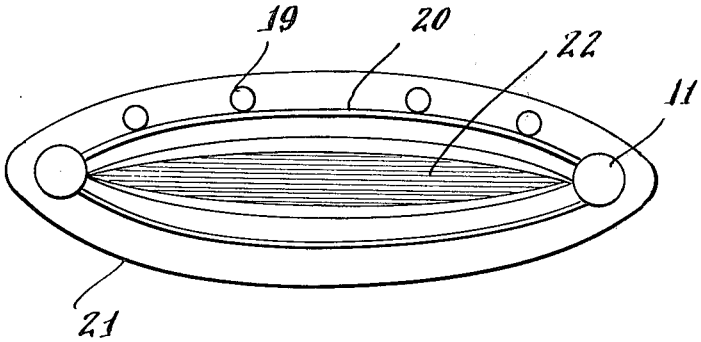
Fig. 6.
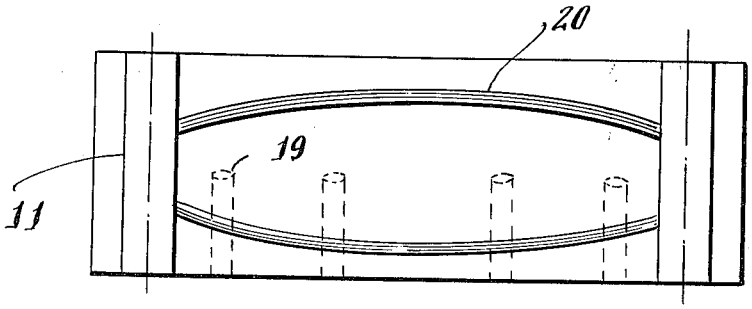

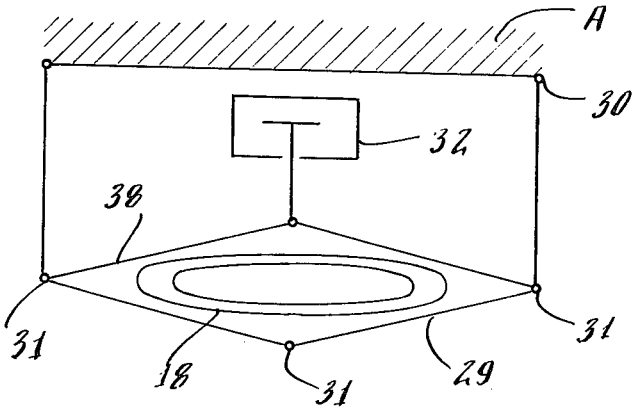
Fig. 7.
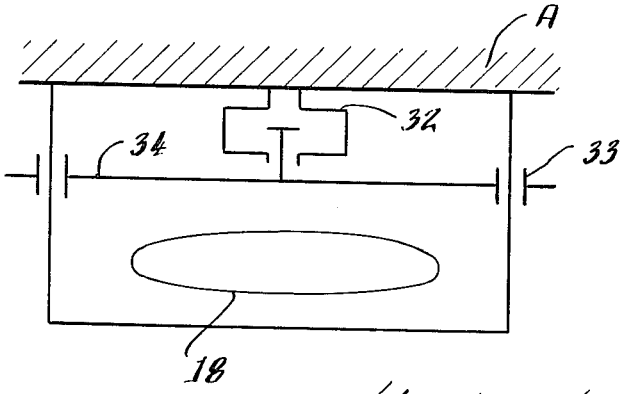
Fig. 8.
Fig. 9.
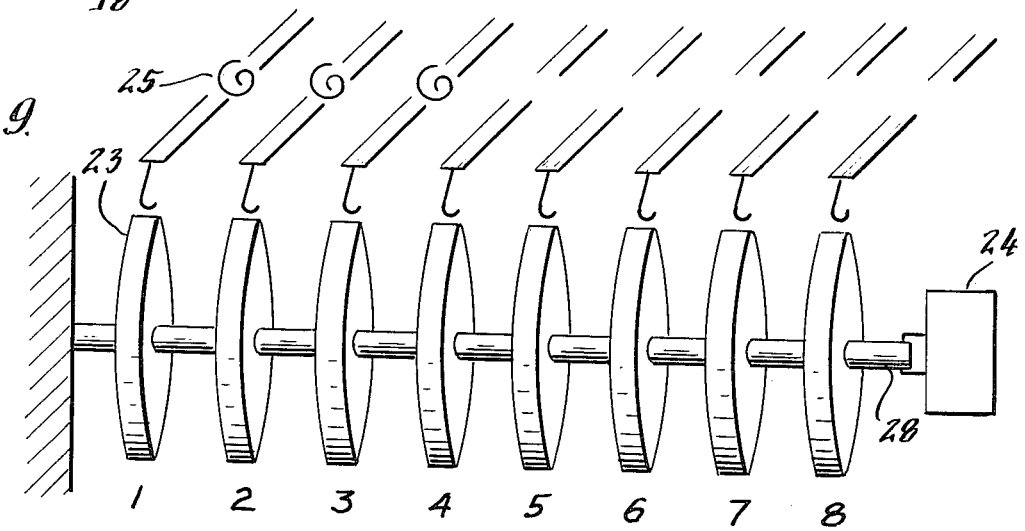
Fig. 10.
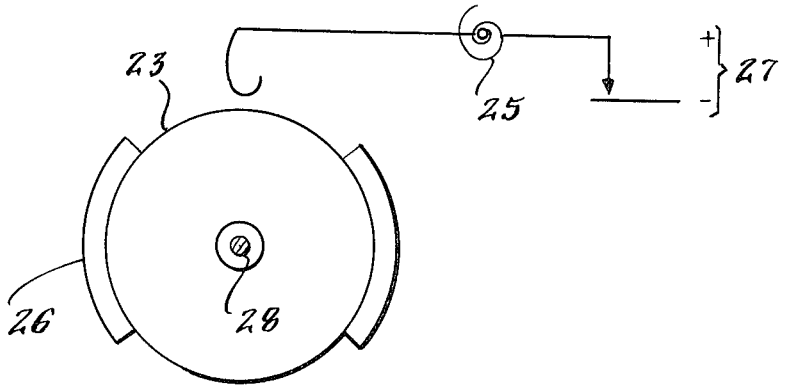

VACUUM BAGGING DEVICE WITH A FLEXIBLE SPOUT AND PROGRAMMING SYSTEM

DETAILED DISCLOSURE

This invention consists of a vacuum programmed bagging device with a flexible spout acting as an air-tight closing system which permits a fast conditioning of materials in powder, granules or ground pulverized or not, under the best conditions of hygiene and rapidity.

It is well known that the purpose of vacuum conditioning is to store within a minimum volume products or materials which are to be protected from air and dampness. Besides, this type of conditioning permits to considerably reduce pollution drawbacks observed with the usual bagging method "all sluice-gates open". This advantage is particularly required in the case of a toxic product producing dangerous aerosols, or depositing on the bag surface preventing later closure of the bag.

The vacuum conditioning industries proceed generally with 4 steps of operations

1st operation: Fitting of a bag on the edges of a closable spout located at the lower part of a tank containing the product to be conditioned.

2nd operation: Filling of the bag by the opening and then the closing of the spout followed by escape of the air from the bag and from its content.

3rd operation: Keeping under vacuum the bag and its content while transferring for next operation. Therefore, up to now, every known conditioning device under vacuum consists in:

a tank to contain the product to be conditioned of which the lower part has a sleeve, a loading funnel and a spout flexible when required and on which can be fitted a bag made of a gluable or thermoweldable material.

an air escape circuit consisting of an air-tight tank kept under vacuum by means of a pump and connected to the air escape circuit (bag and content) by means of a serie of pipes set on the lower rims of the flexible spout.

a mobile mechanical system of gripping allowing to keep the bag and its content under vacuum, this permitting to remove it from the spout and transfer it to the welding or gluing station to obtain definitive sealing of the bag.

a gluing or welding station according to the material of the bag itself. This type of conditioning has numerous drawbacks, specifically:

a feeble air-tight efficiency of the spout to vacuum during processing.

a high difficulty to synchronize perfectly the operations. These drawbacks are hard to overcome in the case of a spout wearing off faster with the friction of the moving on materials being conditioned. The attrition might lead to a change in the time necessary to the escape of the air and to the filling.

With the purpose of preventing these drawbacks, a discontinuous device operated by an electromechanical system with fast response has been submitted. Besides, this device has a flexible or articulated spout of which the opening remains constant in relation to the time, whatever the grade of wear.

This device offers numerous advantages, specifically:

an increase of working frequency efficiency of the conditionally by means of a spout with air-tight closing.

minimum of supervising achieved by memorization of the operations minimum time for air escape absence of pollution For this purpose, the invention is a device which places under vacuum different materials either in powder, or granules, or pulverized, whose feature is a tank ending at its lower part by a flexible spout consisting in two rubber padded blades and two jacks sliding on a guide which act on hammers to shut the flexible or articulated spout, two flaps protecting from any pollution the internal and upper rims of the spout, an electro-mechanical programmer for synchronization, a vacuum pump connected to the spout pipe by means of a tank, an electrovalve, two prehension arms gripping in two steps and under two different pressures the upper rims of the bag to obtain vacuum and moving it in this state towards a gluing or welding station.

The invention will be more clearly understood with the following description which refers to a selected procedure of realization serving as an example, being non-restrictive and which is explained under the references and diagrams joined in annexe, in which:

FIGS. 3 and 4 represent the sections of the articulated spouts diamond-shaped, or flexible and oval-shaped.

FIG. 5 represents the section of a flexible spout in one piece.

FIG. 6 is a diagram of the flexible spout in its longitudinal section.

FIG. 7 represents an obturation system of the sleeve joined to the flexible spout.

FIG. 8 is another fundamental diagram of another obturation system of the flexible sleeve.

FIGS. 9 and 10 represent the memorized electromechanical circuit programming the different operations.

Figure 1:
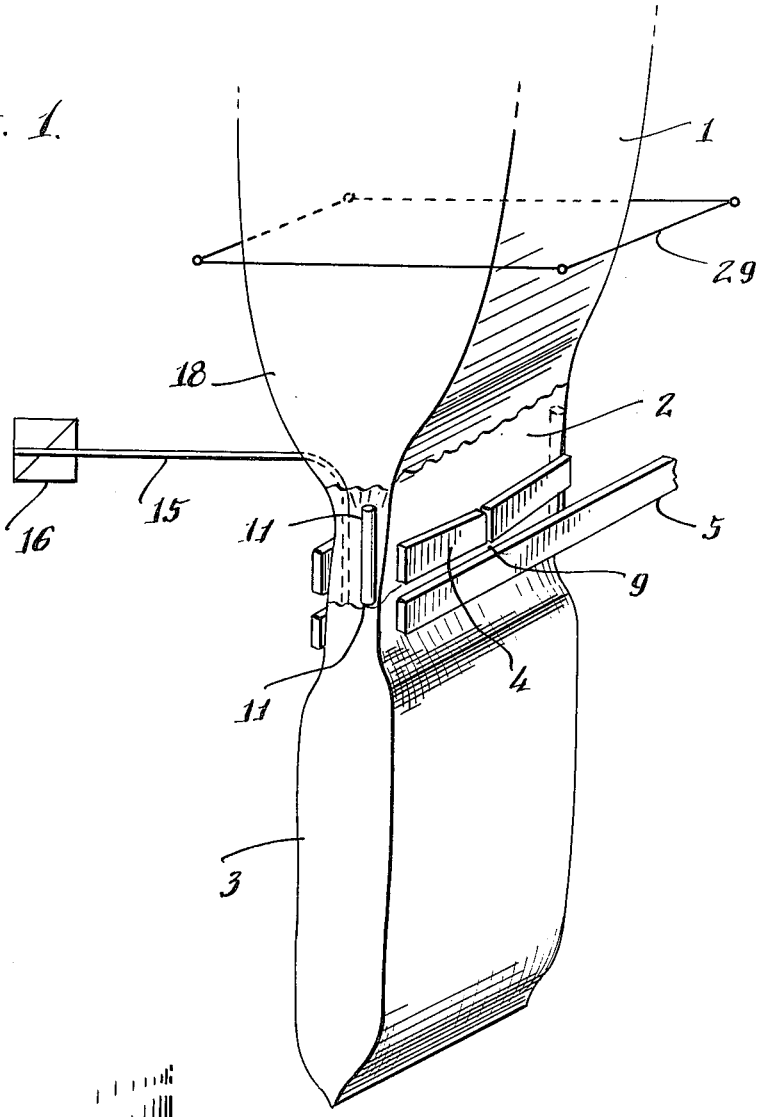
FIG. 1 represents as a diagram the general bagging device under vacuum with the connection on the spout.

According to a first feature of the invention as represented on FIG. 1, the vacuum bagging device with flexible spout consists in a tank (1) terminated on its lower part by a sleeve (18). This sleeve is made with a soft material which can be clamped by a device (29) consisting in articulated steams creating the shape of a distorted parallelogram.

The flexible spout (2) is connected to the sleeve and made of rubber or any other elastic and compressible material.

On the distal parts of the spout the pipes can be seen (11), they act as transmission parts and are connected to jacks. The latter can cause the opening of the spout either by compression or traction.

The opening is synchronized with the articulation of the flaps (4) which apply on the external walls of the spout a pressure which is to ensure air-tightness when filling the bag and the air-escape operation.

The pipe (15) gathers the air escape system and tubulures (19) bedded in the rims of the flexible spout. These pipes (15) and (19) permit on order to create vacuum in the bag (3) and its content, by means of valves and electrovalve circuit (16).

A mechanism acts on the prehension arms (5) compressing more strongly the upper rims of the bag during the transfer operation of the latter towards the gluing or welding station.

Figure 2:
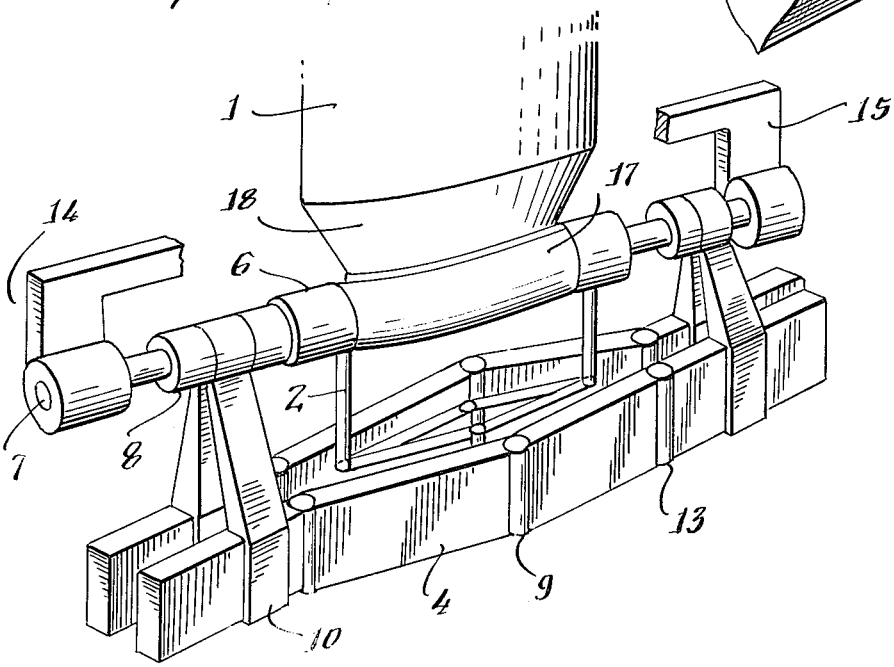
FIG. 2 represents an example of connection of the articulated small plates acting on the spout by means of the jacks.

According to a feature of the invention, the FIGS. 2, 3 and 4 of show two types of spout generally used with their device of opening and clamping.

Refering to FIG. 2, a tank 1 terminated by sleeve (18) can be seen. This sleeve being flexible (rubber) could end with a spout 2 if flexible. In the case of an articulated spout, it is necessary to make a connection by means of a clamping clip (17). When flaps 4 are folded on their hinges 9 and 13, the hammers 6 compress the spout 2 keeping it opened. This compression can be obtained by using two jacks 14 and 15 acting laterally on hinge-pins 8 sliding on guide 7. The strength is communicated in a parallel direction by means of the arms 10 connecting the articulated flaps 4 and hinge-pins 8.

When the spout should close again, the jacks 14 and 15 reduce their pressure, allowing hammers 6 to separate, releasing the spout while the flaps 4 compress the sides of the spout closing it.

In fact, the hinge-pins 8 by sliding on guide 7 oblige the flaps 4 articulated on their hinges 9 and 13 to be again in a position parallel to the transmission arm of the strength 10. The bag which is maintained between the spout 2 and the flaps 4 can be released eventually by making swivel the transmission arms 10 on the hinge-pins 8 so as to separate the flaps 4.

FIG. 3 shows an articulated spout seen from the top. The spout 2 is double walled permitting thus to create a suction. This spout 2 is articulated on hinge-pins 11 and 12 allowing it to open and close. The spout 2 follows as perfectly as possible the profile of the flaps 4 which are articulated on their hinges 9 and 13. The sections of arms 10 have been drawn showing the transmission of the strength to the jacks.

FIG. 4 shows the diagram of the section of a flexible spout 2 according to the features of the invention. This spout consists in two rubber tubes with a steel reinforcement 20. Instead of being double-walled, the spout has air-escape holes 19. Acting on the hinges 11 opens more or less the opening 22. The flaps 4 swiveling on their hinges 9 control opening and closing of this spout.

Another feature of the invention as shown on FIGS. 5 and 6, is the flexible spout drawn in section and plan.

FIG. 5 which is the diagram of the section of the lower part of the one piece spout shows a drawing of the rims 21 made of rubber or any other elastic material. These rims define an oval in which the opening 22 of the spout can be seen in the centre. When the materials of the spout are not very rigid, it is possible to introduce a flexible reinforcement which can be made of two steel blades (20) for instance. These blades are gathered at the tip by control tubulures (11) used to operate the spout. This reinforcement might as well consist in a flexible ring following exactly the oval shape of the spout.

In the rims of the one piece spout air-escape tubulures 19 have been layed running through part of the height of the spout. This arrangement of the tubulures appear more clearly on the FIG. 6 showing a vertical plan of the spout.

According to another feature of the invention, the one piece flexible spout is in extension with the flexible sleeve (18). This sleeve which terminates the tank can be obturated to accelerate the air escape from the product. Furthermore, this arrangement permits to stop flowing of the product avoiding strain on the rims of the flexible spout. A nipping of the sleeve obturates it. There are two different procedures of nipping according to another feature of the invention as shown on FIGS. 7 and 8.

On FIG. 7, section of the sleeve 18 is drawn seen from underneath. A parallelogram 29 articulated on the hinges 31 is distorted according to the action of the applied strength. This strength can be applied by a pneumatical instrument (32) supported on a fixed point A. The lozenge is distorted under the action of device 32 and the nipping action is obtained when the articulated stems 38 are covered. For an easier operation, the fixation points 30 are flexible.

According to another feature of the invention, as shown on FIG. 8, nipping of the sleeve can be obtained by the sliding motion of a stem 34 operated by a pneumatical or mechanical control (32). For an easier operation, there are slide-bars (33) sliding on four parallel and opposite rods arranged as a rectangle. This rectangle cannot be distorted and entwines the flexible part of the sleeve (18). It remains fixed to a base A and the stem (34) slides just enough to obtain the required nipping.

According to another feature of the invention, FIGS. 9 and 10 show the electromechanical programmer. It consists of 8 cam plates (23) driven by the synchronuous motor (24) working with a constant speed. Each cam plate 23 is supported by the driving axle 28. When the motor is in action it drives these plates which act on electrical relay 25. Rubbing of the relay brush on the superthicknesses 26 produces an electric contact at the relay level lasting in relation with the length of the superthickness. By rocking, this relay controls the supply of one of the apparatuses of the device. Each instrument is to operate for a predetermined time.

Thus plate 1 ensures continuous operation of the air escape pump, plate 2 controls the jacks for a determined time, plate 3 the opening and closing of the jacks, plate 4 controls the prehension arms clamping the top of the bag, first under a pressure of 2 bars and then 7 bars. The plates 4, 5, 6, 7 and 8 are to ensure different operations and specially moving of the spout towards the top, transfer of the bag towards the welding station, heating and welding of the bag, opening of the electrovalve.

Operation:

The device operates according to the invention as follows:

A bag is hooked to the spout 2, the jacks 14 and 15 controlled by one of the plates 23 of the programmer compress the flexible or articulated spout 2 at the tips. This action permits the opening of the spout and flowing of the products or materials. When the bag 3 is full, the spout closes by the drawing aside of jacks 14 and 15, and hammers 6 and also the tightening action of the flaps on the spout walls. The flaps 4 apply only a low mechanical pressure on the walls of the spout making then easier to set under vacuum the bag content and does not obturate channels 19 for the air escape. The movement of the prehension arms 5 clamps the bag at 2 bars to create vacuum in the bag, and again at 7 bars to transfer it.

At this moment the spout retracts and draws aside and the bag is transferred towards the welding station under electric control of the programmer.

The welding station consists in electrically heated rods which clamp and seal the non polluated walls of the bag under vacuum and makes it air-tight. After sealing the bag is released.

We claim:

1. A device for vacuum packing a flowable product in a bag, comprising:

a tank adapted to contain a quantity of said product therein;

the lower part of said tank terminating in a sleeve being provided with an articulated or flexible spout comprising a pair of essentially rigid blade members having a padding of rubber or soft plastic material, and equipped with air escape means, a guide, a pair of jacks slidably mounted on said guide, two flaps respectively attached to said pair of jacks for engaging an upper rim of a bag held on said sleeve or spout, means flowably coupled with said spout for producing a vacuum, a pair of prehension arms disposed on opposite sides of said spout in registration with the upper rim of a bag held on said spout, said arms being shiftable toward each other and into engagement with said upper rim of said bag in two steps under different pressures, and an electro-mechanical programmer operably coupled with said sleeve for selectively controlling the flow of said product through said spout, with said jacks for movement along said guide, and with said prehension arms for step-wise engagement of the upper rim of said bag.

2. A device according to claim 1 in which the spout is articulated on a hinge, and is double-walled in metal or plastic to provide the air escape means between said walls, which escape means is connected to the vacuum producing means.

3. A device according to claim 1 in which the tips of the steel blades of the spout are articulated on two hinges and said spout is provided with a plurality of air escape holes.

4. A device according to claim 3, in which the air escape holes are openings in the padding covering the steel blades and communicate with the vacuum producing means.

5. A device according to claim 1, in which the sleeve and spout constitute a single flexible unit.

6. A device according to claims 2 or 4, in which the flaps are adapted to engage the upper rim of said bag to said spout with sufficient pressure to prevent pollution of the spout and the upper rim of the bag by said product and to isolate the interior of said bag from the atmosphere, thereby maintaining the interior of said bag in communication with the vacuum producing means through the air escape means.

7. A device according to claims 2 or 4, in which the prehension arms are adapted so as, in their first engagement step, to apply sufficient compression on the upper rim of the bag to maintain a partial vacuum therein and to permit the escape of air through the air escape means, and, in their second engagement step, to clamp the upper rim of the bag to maintain a partial vacuum therein and obdurate the air escape means.

8. A device according to claim 4, in which the vacuum producing means is connected to the air escape holes through a plurality of tubulures.

* * * * *